US006939256B2

(12) United States Patent
Giacomoni et al.

(10) Patent No.: US 6,939,256 B2
(45) Date of Patent: Sep. 6, 2005

(54) CONCAVE PLAYING SURFACES

(76) Inventors: Paolo Giacomoni, 3 Beverly Rd., Commack, NY (US) 11725; Maurizio Ricci, Via Vitellia 33, Rome (IT), 00152

( * ) Notice: Subject to any disclaimer, the term of this patent is extended or adjusted under 35 U.S.C. 154(b) by 0 days.

(21) Appl. No.: 10/613,805

(22) Filed: Jul. 7, 2003

(65) Prior Publication Data

US 2005/0009648 A1 Jan. 13, 2005

(51) Int. Cl.[7] ..... A63B 67/04
(52) U.S. Cl. ..... 473/496
(58) Field of Search ..... 273/108, 118 R, 273/109; 472/92, 94, 116, 117; 473/496, 459, 473–475; 193/2 R, 6; 446/168

(56) References Cited

U.S. PATENT DOCUMENTS

| | | | | | |
|---|---|---|---|---|---|
| 3,059,927 | A | * | 10/1962 | Kamp | 273/317.4 |
| 3,172,664 | A | * | 3/1965 | Lohr | 273/340 |
| 3,343,793 | A | * | 9/1967 | Waser | 238/10 R |
| 3,656,753 | A | * | 4/1972 | Juneau | 273/122 R |
| 3,951,408 | A | * | 4/1976 | Reiner et al. | 473/107 |
| 4,335,877 | A | * | 6/1982 | Long | 473/475 |
| 4,373,720 | A | * | 2/1983 | Lombardi et al. | 473/434 |
| 4,407,501 | A | * | 10/1983 | Bates | 273/118 R |
| 4,417,728 | A | * | 11/1983 | Hay et al. | 473/435 |
| 5,207,790 | A | * | 5/1993 | Eveillard | 473/29 |
| 5,398,926 | A | * | 3/1995 | Skinner | 473/475 |
| 5,441,455 | A | * | 8/1995 | Carruthers | 473/20 |

FOREIGN PATENT DOCUMENTS

| | | | |
|---|---|---|---|
| FR | 2606653 | * | 5/1988 |
| SU | 1556699 | * | 4/1990 |

* cited by examiner

*Primary Examiner*—Raleigh W. Chiu

(57) ABSTRACT

The invention relates to new tools for a new game. The invention consists of a thin solid object, as can be obtained by slicing a cylindrical crown parallel to its axis, and of a net, which can separate the surface in two parts. This solid object is placed concave side up. It can rest on the ground or be mounted on legs or on floating devices. Different objects can be sent and returned over the net to and from players standing on both sides of the net. To send the objects over the net, the players can use their hands or tools as in the games of tennis, ping-pong, badmington, pelota, lacrosse etc.

19 Claims, 3 Drawing Sheets

CONCAVE PLAYING SURFACES

STATEMENT ABOUT FEDERALLY SPONSORED RESEARCH

This patent application is NOT the consequence of federally sponsored research or development.

BACKGROUND OF THE INVENTION

It has been and still is quite fashionable, to practice indoor or outdoors recreational activities or professional competitions, which consist in sending and returning with the help of appropriate raquetts, a ball or similar objects over a net. Generally, the net separates in two equal parts, a field or a court or even a table, and players usually are distributed for the duration of the game, on one or on the other side of the net. Among the activities which correspond to the above description one finds tennis, badmington, raquett ball, ping pong. One activity which is similar to the ones described above, except for the fact that the players do not remain permanently or semi-permanently in separate parts of the court or of the table is the game called squash, where all of the players move in the same field. Another equally different activity is the game called turning ping pong, where the players, after having sent the ball above a net placed across a table, run to the opposite side of the table and wait for their turn to hit the ball again over the net and run again around the table.

Among the recreational or competitive activities where the game consists in using raquetts to send and return a ball over a net dividing a flat, rectangular table in two equal parts, probably the best known is ping-pong. Ping pong games are rigidly organized and the tools (table raquetts, balls) are strictly defined. The relatively small size of the tables makes ping pong suitable to indoor practicing and the small mass of the ball commands total lack of wind for a competition to be plaid outdoors in all fairness. The practice of ping pong requires perfect vision, good reflexes, physical strength and endurance, which are not always met by the average individual willing to have fun while playing with is children or friends.

The present invention concerns new tools to perform a recreational activity or competitive game, consisting in sending and returning an object, usually a ball, over a net using appropriate raquetts. The tool is so designed as to make the practice of this activity easier for beginners, and excruciating for expert players, so that it will never be felt as dull or boring, but always undertaken with thrill and enthousiasm.

DESCRIPTION OF THE SEVERAL VIEWS

Figure 1:
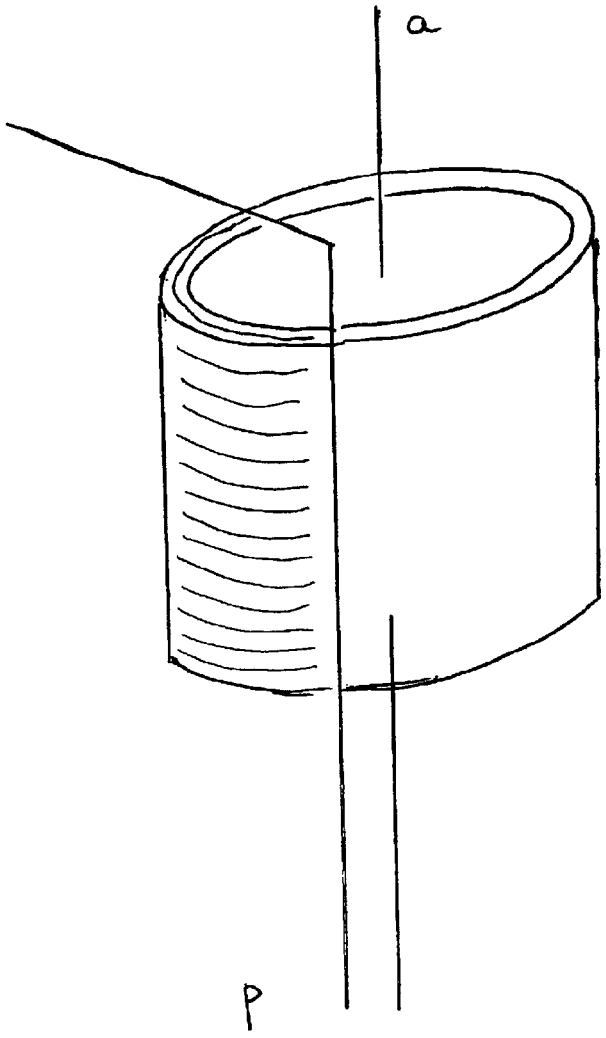

FIG. 1 An illustration on the geometrical properties of the invention. A cylindrical crown is defined as the part of space comprised between the surfaces of two cylinders with the same axis (a), the same height and different diameters. When a cylindrical crown is secated by a plane (p) parallel to the axis, two objects are obtained. In the figure, the shadowed region depicts the object of the invention.

Figure 2:
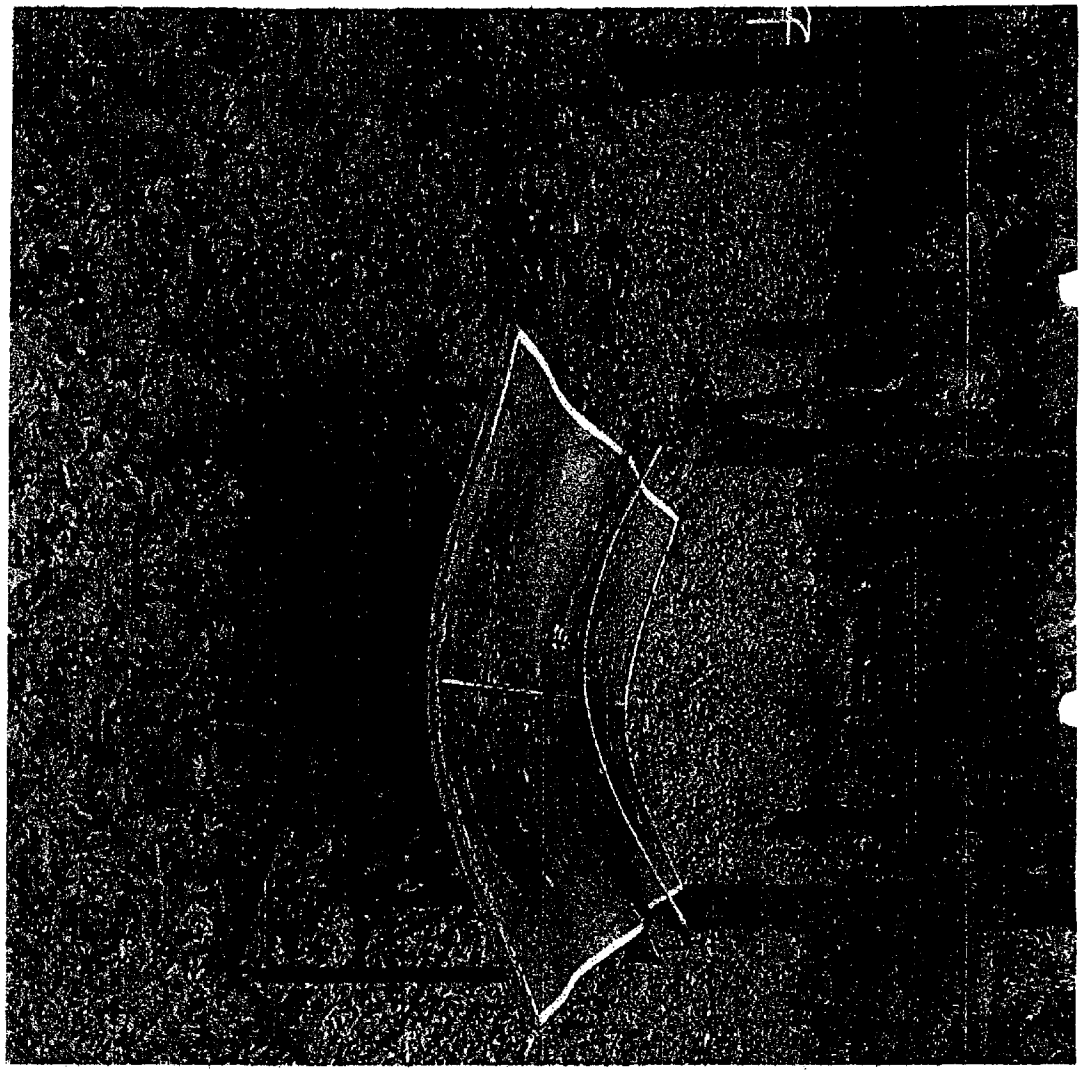

FIG. 2. A prototype of the invention. In this particular case, the dimensions of the object of the invention are such that it can be mounted on the frame designed to support a classical ping-pong table.

Figure 3:
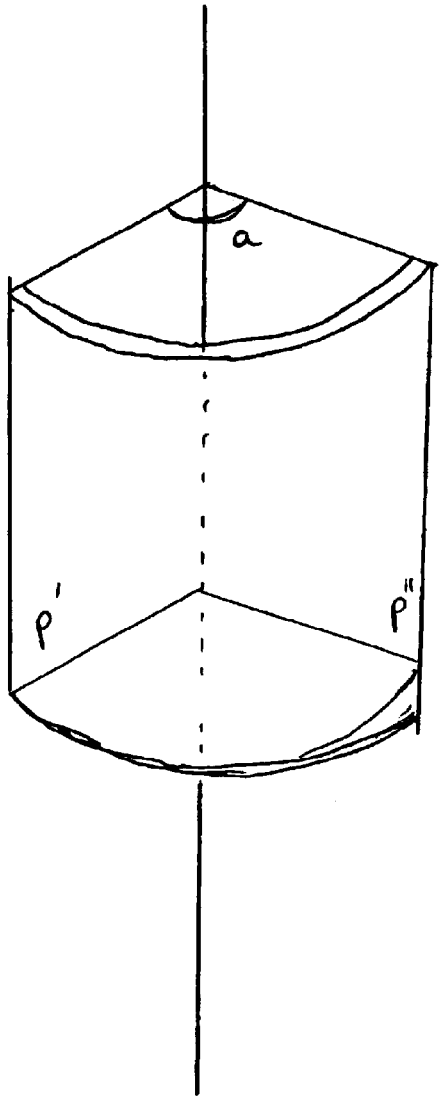

FIG. 3. Description of the geometric parameters defining the invention. Together with the diameter of the cylindrical crown and the length of the straight edges, the object of the invention is characterized by the dihedral angle (a) formed by the two planes (p' and p") containing the axis of the cylinder and one or the other of the long edges.

DETAILED DESCRIPTION OF THE INVENTION

The invention relates to a tool designed to allow the practice of a new recreational activity or competitive game. This new activity or game can be practised indoor or outdoor, on the ground or in water, as for instance in a garden, on the beach, in a swimming pool or in a lake.

The invention consists of a curved solid table or floor, the surface of which is usually in the shape which can be obtained by slicing a cylindrical crown, parallel to the axis of the cylinder (FIG. 1). This surface is usually placed concave side up, directly resting on the ground or mounted on legs or on floating devices, and can be virtually separated in two, usually equal, parts, by a net usually mounted perpendicularly to the axis of the cylinder (FIG. 2). On this surface, objects of different forms, volumes and masses, usually spherical, a few centimeters in diameter and weighing a few grams, can be sent and returned over the net to and from players standing on one or on the other side of the net. To send the objects over the net, the players use raquetts, usually made of wood or plastic or of any other material, usually in the shape of flat circle, elippse or square or any other shape suitable to render easier or more difficult at will, the practice of the activity.

The overall size of the surface determines whether the activity is practiced by players standing and moving around the surface itself, as it is the case in the game usually caalled ping pong, or by players moving on the surface itself, as it is the case in the game of tennis. The invention will be then separately described for the two possibilities, i.e.

- the curved surface is mounted on supports and the players do not stand on it
- the curved surface is resting on the ground and the players do stand and move on it.

First case: the curved surface is mounted on supports and the players do not stand on it.

The surface will have variable dimensions. The length will be between 1 and 12 meters (3.28 to 39.37 ft.), preferably between 2 and 6 meters (6.56 to 19.69 ft.). The width will be between 50 cm and 6 meters (1.64 and 19.69 ft.), preferably between 1 and 3 meters (3.28 and 9.84 ft.). The thickness of the curved crown will be between 0.5 and 90 cm (0.02 and 2.95 ft.) according to the material, preferably between 2 and 10 cm (0.07 and 0.33 ft.). A prototype is depicted in FIG. 2. The curved surface can be obtained in any possible way known to the expert in the field of molding or carving objects made of plastic, metal, Plexiglas, inflatable material, wood. In the case in which the surface is obtained by slicing a regular cylindrical crown, the curvature of the surface will be such that the concave dihedral angle formed by the two planes containing the axis of the cylinder and one of the outer edges of the long sides, will have values between 5 and 180 degrees, preferably between 20 and 90 degrees (FIG. 3).

The net across the surface will be made with any type of material, flexible textiles like cotton or nylon held by appropriate devices as well as rigid materials such as wood, plastic, Plexiglas or metal. The dimensions of the net will be appropriate to match the width of the surface, although in some instances the net could be smaller and provide only a partial obstacle to the movement of the object sent across the table by the players, The height of the net can vary between 5 and 150 cm (0.16 and 4.92 ft.), preferably between 10 and 30 cm (0.33 and 0.98 ft.). The surface can rest on a frame of wood, metal or plastic, of the appropriate dimensions to hold it firmly, and maintain it at a distance from the ground varying between 20 and 190 cm (0.66 and 6.23 ft.), preferably between 60 and 120 cm (1.97 and 3.94 ft.). For practicing in water, the frame can be added with appropriate floating devices to maintain it at the desired height above the surface of the water.

Second case: the curved surface is resting on the ground and the players practice the activity while standing or moving on it.

The surface will have variable dimensions. The length will be between 3 and 50 meters (9.84 to 164.04 ft.), preferably between 7 and 24 meters (22.97 to 78.74 ft.). The width will be between 1 and 20 meters (3.28 and 65.62 ft.), preferably between 2 and 10 meters (6.56 and 32.81 ft.). The thickness of the curved crown will be between 0.5 and 30 cm (0.02 and 0.98 ft.), according to the material, preferably between 2 and 10 cm (0.07 and 0.33 ft.). The curved surface can be obtained in any possible way known to the expert in the field of molding or carving objects made of plastic, metal, Plexiglas, inflatable material, wood, etc. In the case in which the surface is obtained by slicing a regular cylindrical crown, the curvature of the surface will be such that the concave dihedral angle formed by the two planes containing the axis of the cylinder and one of the outer edges of the sides, will have values between 5 and 180 degrees, preferably between 20 and 90 degrees (FIG. 3).

The net across the surface will be made with any type of material, flexible textiles like cotton or nylon held by appropriate devices as well as rigid materials such as wood, plastic, Plexiglas or metal. The dimensions of the net will be appropriate to match the width of the surface, although in some instances the net could be smaller and provide only a partial obstacle to the movement of the object sent across the table by the players. The height of the net can vary between 10 cm and 2 meters (0.33 and 6.56 ft.), preferably between 50 and 120 cm (1.64 and 3.94 ft.).

The surface can rest on a frame of wood, metal or plastic, of the appropriate dimensions to hold it firmly, but can also be in direct contact with the ground. The ground can have been conveniently dug to allow the surface to rest firmly on it, but can also be left flat and the surface can roll when the players move on it. When the ground is dug in the appropriate way, the surface can be covered by any other materials such as concrete or tar, or tiles, or parallelepipeds of wood or plastic, or any other kind or material in whatever shape, to achieve a surface where objects can bounce and players can move. When the surface can roll, it can also be designed in such a way that the two halves on both sides of the net are not solidarious, and can thus freely roll according to the desire of the players on each half, or according to the position they occupy while playing.

Advantages of the Invention

When compared to the recreational activities or competitive games consisting in sending and returning a ball over a net to and from players placed on opposite sides, the invention provides a multitude of advantages.

In the case of a curved surface mounted on a frame, the invention offers the advantage of allowing an activity easily accessible to children or to adults not acquainted with quick moving objects, because the curved surface helps the players to maintain the direction of the ball or of the bouncing object within a narrower angle. This allows inexperienced, or physically unfit, players to reach easily for the ball or the object, thus enjoying the game without the frustration of the interruptions which are the consequence of a too frequent missing the ball. On the other hand, experienced players will enjoy the game because the curvature of the surface will make it difficult to predict or guess the direction of the ball or of the object after the rebouncing, when the ball is sent by an experienced plaayer towards the edges of the curved surface. This adds a thrill and renewed difficulty at every stage of progress in the skills of the game. Last but not least, the possibility to practice the game on a surface floating in water offers unprecedented reasons for fun and sport.

In the case of a curved surface on the top of which the players stand and move, the advantages are paramount for the experienced players, who will find it more challenging to predict or to guess the trajectory of the ball after rebouncing. When the surface can roll, and even more so when the two halves of the surface can roll independently from one another, the skill of the players will be not only to reach the returning ball and guess it direction, but also to influence its direction by appropriately positioning themselves on the surface so as to modify the angle of impact of the arriving ball with the moving surface. This too adds a thrill and renewed difficulty at every stage of progress in the skills of the game.

What is claimed is:

1. A concave surface for ball and racquet games, the surface comprising:

a cylindrical crown having:

a central axis, a diameter, first and second curved edges perpendicular to the central axis, first and second straight edges parallel to the central axis, a dihedral angle (a) formed by two planes (p' and p") that contain the central axis of the crown and one or the other of the straight edges; and a net positioned perpendicular to the central axis and dividing the curved surface in equal halves.

2. The concave surface of claim 1 such that the dihedral angle is between 5 and 180 degrees.

3. The concave surface of claim 2 such that the dihedral angle is between 20 and 90 degrees.

4. The concave surface of claim 1 wherein the length of the straight edges is between 1 and 12 meters (3.28 and 39.37 ft.).

5. The concave surface of claim 4 wherein the length of the straight edges is between 2 and 6 meters (6.56 and 19.69 ft.).

6. The concave surface of claim 1 wherein the width of the curved edges is between 50 cm. and 6 meters (1.64 and 19.69 ft.).

7. The concave surface of claim 6 wherein the width of the curved edges is between 1 and 3 meters (3.28 and 9.84 ft.).

8. The concave surface of claim 1 wherein the thickness of the curved crown is between 0.5 and 90 cm. (00.02 and 2.95 ft.).

9. The concave surface of claim 8 wherein the thickness of the curved crown is between 2 and 10 cm. (0.07 and 0.33 ft.).

10. The concave surface of claim 1 wherein the concave surface is supported above the ground on legs.

11. The surface of claim 10 wherein the surface is elevated above the ground between 20 and 190 cm. (0.66 and 6.23 ft.).

12. The surface of claim 11 wherein the surface is elevated above the ground between 60 and 120 cm. (1.97 and 3.94 ft.).

13. The concave surface of claim 1 wherein the concave surface is directly supported by the ground.

14. The concave surface of claim 13 wherein the length of the straight edges is between 3 and 50 meters (9.84 and 164.04 ft.).

15. The concave surface of claim 14 wherein the length of the straight edges is between 7 and 24 meters (22.97 and 78.74 ft.).

16. The concave surface of claim 13 wherein the width of the curved edges is between 1 and 20 meters (3.28 and 65.62 ft.).

17. The concave surface of claim 16 wherein the width of the curved edges is between 2 and 10 meters (6.56 and 32.81 ft.).

18. The concave surface of claim 13 wherein the thickness of the curved crown will be between 0.5 and 30 centimeters (0.02 and 0.98 ft.).

19. The concave surface of claim 18 wherein the thickness of the curved crown is between 2 and 10 centimeters (0.07 and 0.33 ft.).

* * * * *